United States Patent [19]

Smith, III

[11] Patent Number: 4,517,423

[45] Date of Patent: May 14, 1985

[54] HUMAN BODY ACTIVATED SWITCH

[76] Inventor: William N. Smith, III, P.O. Box 1061, Carrollton, Tex. 75006

[21] Appl. No.: 385,016

[22] Filed: Jun. 4, 1982

[51] Int. Cl.[3] ..... H01H 35/00

[52] U.S. Cl. ..... 200/52 R; 200/DIG. 2

[58] Field of Search ..... 200/52 R, DIG. 2

[56] References Cited

U.S. PATENT DOCUMENTS

| | | | |
|---|---|---|---|
| 1,402,609 | 1/1922 | Hodous | 200/DIG. 2 |
| 2,210,330 | 8/1940 | Sequin et al. | 200/DIG. 2 |
| 3,054,868 | 9/1962 | Phillians | 200/DIG. 2 |
| 3,363,242 | 1/1968 | Currey et al. | 200/DIG. 2 |
| 3,524,030 | 11/1968 | Wiegel | 200/52 |

*Primary Examiner*—J. R. Scott

*Attorney, Agent, or Firm*—Hubbard, Thurman, Turner & Tucker

[57] ABSTRACT

A user operated switch has a support frame mounted to a person's body. A first electrical contact is mounted on and extends from the frame. Contacting structure includes a friction device positioned against a portion of the person's skin and is supported by an electrically conductive support arm. An electrically conducting lever arm has a first end mounted in the friction device in electrical contact with the support arm. A second end of the lever arm is located adjacent the first contact. Skin movement will cause contact between the first contact and the lever arm. The switch may be modified to act as a double throw, single pole switch.

6 Claims, 9 Drawing Figures

HUMAN BODY ACTIVATED SWITCH

BACKGROUND AND SUMMARY OF THE INVENTION

The present invention relates generally to communications devices for the handicapped, and more specifically to an improved scanning process for use with lists and matrices.

Many attempts have been made to enable persons with motor and/or speech impairments to communicate more effectively with others. Methods presently in use generally employ one or more electrical switches coupled to an electronic control circuit. Closure of these switches by the user allows desired symbols or preselected phrases to be chosen and communicated to others. Typically, a keyboard of some type is coupled through control logic to a printer or lighted display.

Keyboards of any type have serious drawbacks in that they are not suitable for use by many handicapped or impaired persons. Although these persons may have good cognitive faculties, due to various physical impairments they are not able to accurately select and close the contacts on a keyboard matrix.

One alternative to the matrixed keyboard input is the use of a single switch, coupled with a dynamic presentation of the items to be selected. For example, a row or matrix of lights corresponding to letters of the alphabet or preselected messages can be individually, sequentially lighted. The user is then able to make his selection by closing the single switch while the desired item is being presented. This method has advantages in that it is inherently very simple to use and understand by anyone who is able to manipulate a single switch.

However, such a method has a serious drawback in that selection of individual items can be extremely time consuming. Each item must be presented for a long enough time period to insure that the user will be able to comprehend that his desired item is being presented, and make the necessary switch closure. For most impaired persons, such a period runs several seconds, and may run several tens of seconds for some. If an item must be selected from a group or list of forty or more elements, it is easily seen that the element selection process may take several minutes. This is especially true when the user's attention wanders, causing him to miss the desired selection and requiring him to wait for the scanning process to return. This wandering of attention is an important problem, and is greatly exaggerated by the fact that the user must wait a long time for his selected element to be presented. Long delays cause boredom and frustration, and may sharply curtail the use of an otherwise helpful communication aid.

It would be desirable to provide a communications method and device which utilizes a dynamic scanning presentation of elements for selection by the user. It is further desirable that the element selection can be made by operating a single switch, and it is extremely desirable that the average selection time and quantity of switch operations per selection is kept to a minimum.

Therefore, according to the present invention, a method for dynamic scanning of lists or arrays comprises the steps of scanning through the list in a forward direction at a speed greater than the response time of the user, and, upon receipt of a switch closure, reversing direction and scanning at a slow speed, thereby allowing item selection upon a second switch closure by the user. The forward and reverse scanning speeds are preferably dependent on parameters established by the response abilities of the user.

It is preferable that a device constructed according to the present invention be able to interface with a variety of communications devices. Therefore, the present invention provides a general apparatus for providing the scanning and interpreting of switch closures, and allowing interfacing with a communications device to be selected by the user. Thus, modifications of the device disclosed in connection with the drawings can be used to interface the impaired user with a variety of electronic and microprocessor driven displays and devices.

The novel features which characterize the present invention are defined by the appended claims. The foregoing and other objects and advantages of the invention will hereinafter appear, and for purposes of illustration, but not of limitation, a preferred embodiment is shown in the accompanying drawings.

DESCRIPTION OF THE PREFERRED EMBODIMENT

Figure 1:
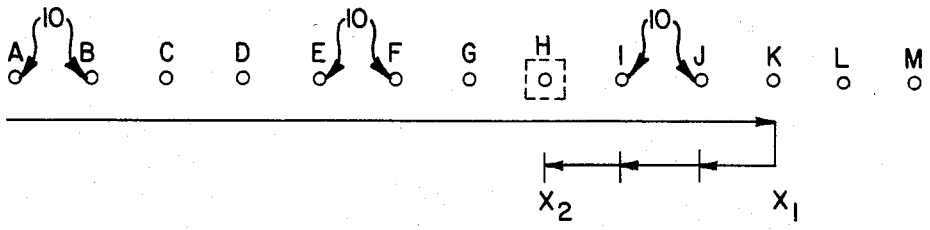
FIG. 1 is an illustration of the method of the present invention.

The method and apparatus of the present invention encompasses certain communications devices suitable for use by handicapped persons. The present invention is especially suitable for use by those who must use a non-speech form of communication and do not have the dexterity to operate a keyboard instrument efficiently. An instrument constructed according to the present invention can be used to interface the impaired person with nearly any device allowing him to communicate with others.

Linear scanning of the alphabet is a desirable way for the impaired individual to communicate with others. Use of the alphabet allows the individual to communicate without any limitations on the words he may use to express himself, a problem which is prevalent with the use of preselected vocabulary. The linear scanning concept is simple for the user in that each letter of the alphabet is presented sequentially to the handicapped individual, and he typically indicates his selection of the desired letter by closing a switch when that letter appears. After the selected letter is registered, the scanning process begins again and the individual selects the next letter. It will be appreciated that numbers and other symbols can be, and usually are, presented to the individual in addition to the alphabet.

Such a linear scanning technique is an extremely time consuming process. It will be appreciated that, in order to function properly, the sequential presentation of elements, which can be letters or other symbols, must be done at a rate which is slower than the response time of the impaired individual to ensure proper selection. If the scanning rate is too fast, the individual must try to anticipate when the desired element will be presented, and try to time his switch operation to coincide with such presentation. This is a highly inaccurate procedure at best. "Reliable response time" may be conveniently defined as that period of time in which the individual is virtually assured of being able to complete the selection process. This process includes the perception of the element (symbol) presently being displayed, the decision as to whether or not it is the element desired for selection, and the actual physical manipulation of a switch to indicate selection. For severely handicapped individuals, such as those with certain nervous or muscular disorders, the reliable response time may be fairly long. This can be the case even with persons whose intellectual capabilities are virtually unimpaired. A reliable response time of three to five seconds is not uncommon, and times of ten seconds or more are sometimes encountered. Since in many instances the attempt to have the individual anticipate the occurrence of his desired letter or symbol actually increases the reliable response time, due to distraction and other factors, it will become apparent to those skilled in the art that each element presented to the individual must be presented for a period of time at least as long as his reliable response time.

It will quickly become apparent that the selection of each symbol can be a time consuming process indeed. As a rough approximation of the average time required to select each symbol, it is safe to assume that the average number of symbols which must be passed before reaching the chosen one lies at approximately the midpoint of the number of symbols in the list. Thus, for a list of the alphabet, plus perhaps 8–10 additional symbols, it would be expected that, on the average, approximately fifteen symbols must be presented to the individual for each one that is selected. This assumes that the individual actually captures the selected symbol the first time around every time. Obviously, if this is not the case, the entire list must be scanned again prior to selection of a single symbol. If an average of fifteen symbols per selection is assumed, and the person's reliable response time is five seconds, it is seen that the average capture time per selection is 75 seconds, assuming no mistakes. Thus, such a linear scanning process is, at best, extremely tedious and time consuming.

Although it is possible to decrease the average selection time of the characters by placing the most frequently chosen characters toward the beginning of the list, it has been determined that presenting the symbols out of a known order, such as alphabetical or numerical order, creates confusion on the part of the user and is often counterproductive.

The present invention employs a two step sequential scanning process of a list or array of symbols which greatly improves the selection time per symbol over the linear scanning method. This improved scanning method will sometimes be referred to as "critically damped scanning". The method of the present invention is best described with relation to FIG. 1, which shows a string of lights 10 which are sequentially lighted. Each light corresponds to a letter of the alphabet, and they are individually lit in sequence beginning with A. In the present invention, the serial activation of the lights 10 corresponding to the letters of the alphabet occurs at a rate much faster than the reliable response time of the individual. For example, if the reliable response time is approximately five seconds, the lights 10 in FIG. 1 can be activated at one second intervals. When such a high speed scan is used, the individual looks at the target letter and attempts to operate a switch when his target letter lights up. Since the scan rate is faster than his response time, the light actually being presented at the time the switch is depressed will not be the selected letter. FIG. 1 shows a typical example in which the desired selection is the letter H, and activation sequence has moved on to the letter K by the time switch closure is actually made at point $X_1$. The lighting sequence then reverses direction and sequentially lights the letters at a slower rate, which is determined by the reliable response time of the individual, and is the same rate as the linear scan discussed above. He is then able to close the selection switch a second time when the letter H is activated the second time, shown as point $X_2$ in FIG. 1.

Figure 2:
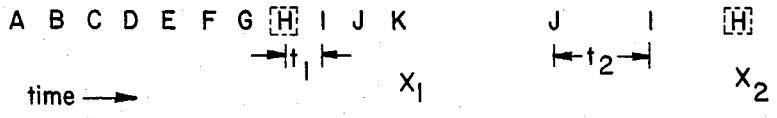
FIG. 2 is a timing diagram corresponding to the method of FIG. 1.

A timing diagram of the selection procedure of FIG. 1 is shown in FIG. 2. Here, it is seen that the letters are presented in forward sequence at short time intervals $t_1$. The switch operation to select the letter H actually takes place at a later time, in the case of FIG. 2 while the forward scanning process is on the letter K at point $X_1$. At that time, the scanner reverses direction and presents each letter for a longer time interval $t_2$, which is as long as the reliable response time of the individual. When the scanner reaches the letter H on the reverse scan, the switch is closed again, at point $X_2$, thereby indicating that the letter H has been selected.

An apparatus constructed according to the present invention also preferably incorporates means for terminating the reverse scan if a selection is not indicated by a second switch closure within a preselected number of presentations on the reverse scan. If the selection is not made within this preselected number, the forward scanning sequence will start again at the beginning of the list. In this way, a minimum amount of time will be wasted during the slow speed reverse scan if the switch was initially closed by accident or too early in anticipation of the desired selection.

It will become apparent to those skilled in the art that the present invention need not be limited to linear strings of lights. Lights can be arranged in arrays which are scanned row by row, or in other patterns. A large matrix can be scanned by rows to select the row the desired element is on, and then the row is scanned to select the desired element on that row. It is not necessary to use lights at all with the present invention. For example, serial presentation of the alphabet can be made by audio means, such as through an electronic voice synthesizer. The letters can be presented at a rate faster than the reliable response time of the individual, and recited in reverse order, in the manner of FIG. 2, when the first switch closure is made. The same technique may be applied to pictures projected on a screen. The time to scan the entire list is much shorter than with the linear scanning method, which greatly decreases total selection time if the individual does not select the desired symbol the first time around.

It will be apparent that tremendous time savings can be had through use of critically damped scanning. For the selection of each element, only a small number of presentations are made at the slow speed necessary for a response by the individual. The remainder are made at a higher speed, which allows the list to be scanned much more rapidly. The actual time savings are a function of the forward scan speed selected, the reliable response time of the individual, and the number of mistaken switch closures made by the individual. These factors are interrelated to a great extent. For example, the reverse scan speed must be no faster than the reliable response time of the individual. A large portion of the potential time savings is unrealized if a large number of presentations must be scanned at the slower reverse speed. Preferably, the maximum of reverse presentations is given by the formula:

$$r=R/f \quad (1)$$

where r is the number of presentations made during the reverse scan, f is the presentation time for each letter during the forward scan, and R is the reliable response time of the individual. Thus, if the forward scanning rate is five times the reliable response time of the individual, the maximum number of presentations made in the reverse scan made prior to resetting the forward scanning procedure should be five. The selection of r in this manner causes the reverse scan of the same number of elements as are forwardly scanned in the time R. If the reliable response time was properly chosen, the individual will complete the first switch closure before the forward scan has gone more than five presentations beyond the desired selection. A greater number of reverse scan presentations will cause a waste of time if a switch closure is accidentally made during the forward scan, and a smaller number will not insure that the desired selection will be reached on the reverse scan prior to resetting.

The selection of the forward scan presentation time (f) depends on several factors. Foremost is the recognition time of the individual. Irregardless of the total reliable response time, from recognition through switch closure, the forward scan presentation time must be long enough that the individual can recognize that his desired selection has been presented. Thus, if the individual takes one second to recognize a presentation, and two more seconds to be certain of switch closure upon recognition of the desired symbol, the forward scan rate can be no faster than one presentation per second. Typically, lamps or LEDs are used to present the symbols, and the recognition time is much faster than this. Thus, the forward presentation rate can be substantially faster.

If the recognition time of the user is a limiting factor, the forward scan speed can be increased by activating two or more lights simultaneously in an overlapping sequence. Thus, the next 1 or 2 elements are activated while the element in question remains activated. This allows each element to be activated for a period exceeding the user's recognition time while the time between successive presentations is shortened below the recognition interval. The use of a capacitor in parallel with the light or LED causes a sufficient delay. Since recognition time is usually not a limiting factor, the embodiment disclosed below will assume the individual presentations are sufficient.

Another factor to consider is the relationshp between the typical number of reverse scan presentations needed and the total number of elements in the list. Since the number of reverse scan presentations made is related to the forward scanning rate by equation (1), a high forward scan rate causes a high number of reverse presentations to be necessary for each selection. Little benefit is gained when the expected number of reverse scan presentations is large in comparison to the total number of elements in the list. It has been determined that setting the maximum number of reverse scan presentations at five for most arrays is fairly efficient. The scanning rates and number of presentations are referenced to the basic time unit of the reliable response time of the individual using the device, and are adjusted to retain proportional relationships when used by individuals having different reliable response times.

For purposes of discussion, a preferred apparatus embodying the present invention includes control circuitry and interfacing adapted to operate in conjunction with a Texas Instrument Speak & Spell, a consumer product which utilizes audio and visual feedback to assist the operator in learning spelling. The standard consumer item utilizes a matrixed keyboard for input. The preferred embodiment discussed below shows the circuitry necessary for an impaired individual to use such a product with the scanning method described above.

Figure 4:
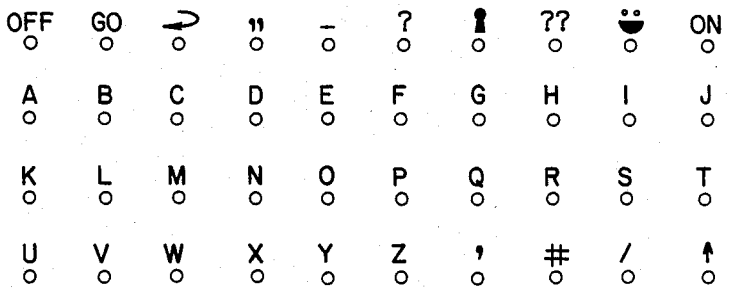
FIG. 4 is a diagram of a particular keyboard as used with a preferred embodiment of the invention.

FIG. 4 shows a diagram of the modified keyboard of the Speak & Spell suitable for use with the present invention. Each letter and symbol has a corresponding LED, and these are lit sequentially as described above. The scanning sequence begins with the ON position, and scans each row from left to right, returning to the top row after the bottom row has been scanned. If no switch closures are made, the forward scanning will cycle endlessly through the matrix.

Figure 3:
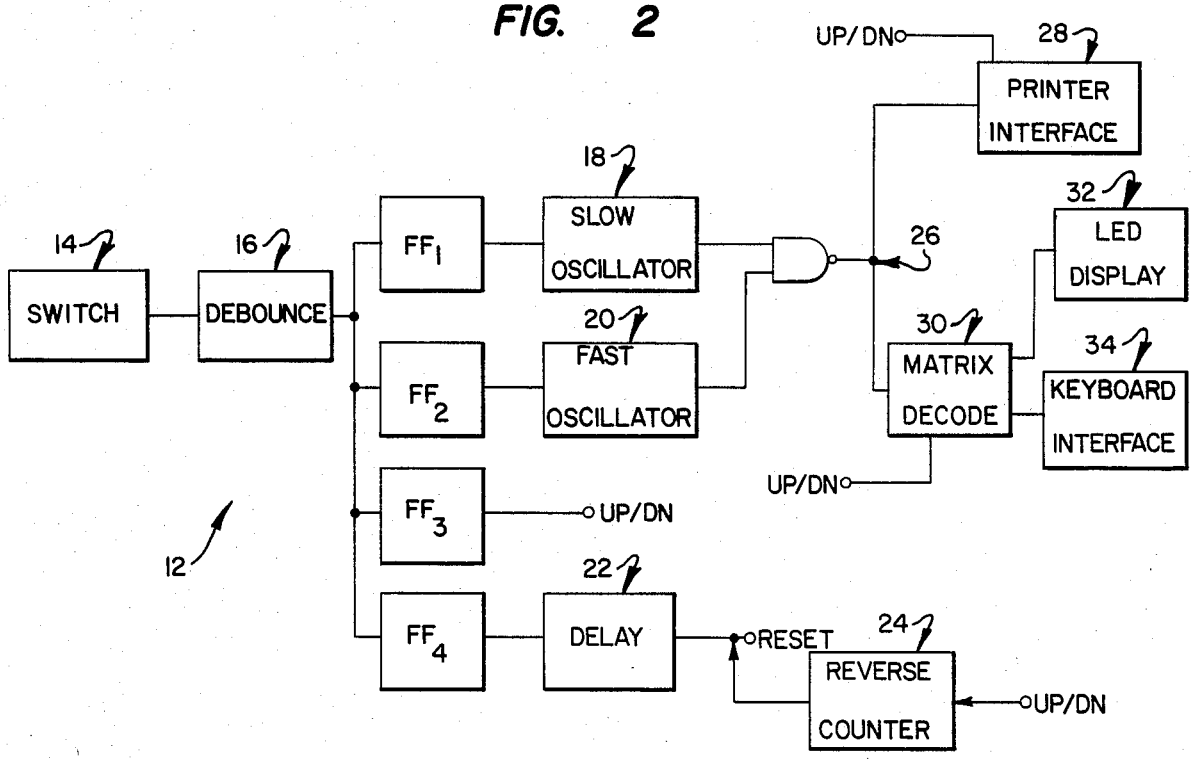
FIG. 3 is block diagram of a device for scanning an array according to the present invention.

FIG. 3 shows a block diagram of the preferred apparatus 12. A switch 14 is operable by an individual, and is coupled to the device 12 through a debounce circuit 16. The debounced switch closure signal is coupled to the clock inputs of four flipflops $FF_1$, $FF_2$, $FF_3$, and $FF_4$. $FF_1$ controls a slow speed oscillator 18, used to drive the reverse scan. $FF_2$ controls a fast oscillator 20, used to run the forward scan. Both oscillators 18, 20 have adjustable frequency outputs. $FF_3$ is used to control the direction of the scan, and $FF_4$ is coupled to a delay circuit 22, the output of which resets the entire circuit. A reverse counter 24 will also reset the circuit when the desired number of presentations have been made on the reverse scan. The outputs of the oscillators 18, 20 are NANDed together to give a single clock signal 26 for the remainder of the circuit. This clock signal 26 drives a printer interface circuit 28, used to connect to an optional printer (not shown), and a matrix decode circuit 30, which sequentially steps through the elements to be presented to the user and decodes them to drive the matrix of FIG. 4, represented by an LED display 32. The matrix decode circuit 30 also drives a keyboard interface circuit 34, which is used to inform a microcomputer contained in the Speak & Spell as to the identity of an element which has been selected.

When the apparatus 12 is initialized at power up, or has been reset after an element selection, the output of the fast oscillator 20 is driving the matrix decode circuit 30 so that the elements are being presented in the forward scan mode. The initial states of the flipflops $FF_1$, $FF_2$, $FF_3$, and $FF_4$ are such that the fast oscillator 20 is operating, the slow oscillator 18 is not operating, and an UP/DN output is "up", so that the elements are being scanned in the forward mode. The initial operation of the switch 14 causes the flipflops $FF_1$, $FF_2$, $FF_3$, $FF_4$ to change state, so that the slow oscillator 18 is driving the matrix decoder 30 in the down, or reverse, direction. The down signal enables the counter 24, which is preset to reset the device 12 after the desired maximum number of reverse scan presentations have been made. The device 12 continues to reverse scan until the counter 24 indicates that the maximum number of presentations have been made, or until a second switch closure occurs. At the second switch closure, the slow oscillator 18 ceases operation and the matrix decode circuitry 30 locks in the selected elememt. $FF_4$ triggers the delay circuit 22, which resets the device 12 after a predetermined delay. The matrix decode circuit 30 enables the keyboard interface 34 after the second switch closure so that the selected element is entered into the operational communications device (not shown), in this case a Speak & Spell.

Figure 5:
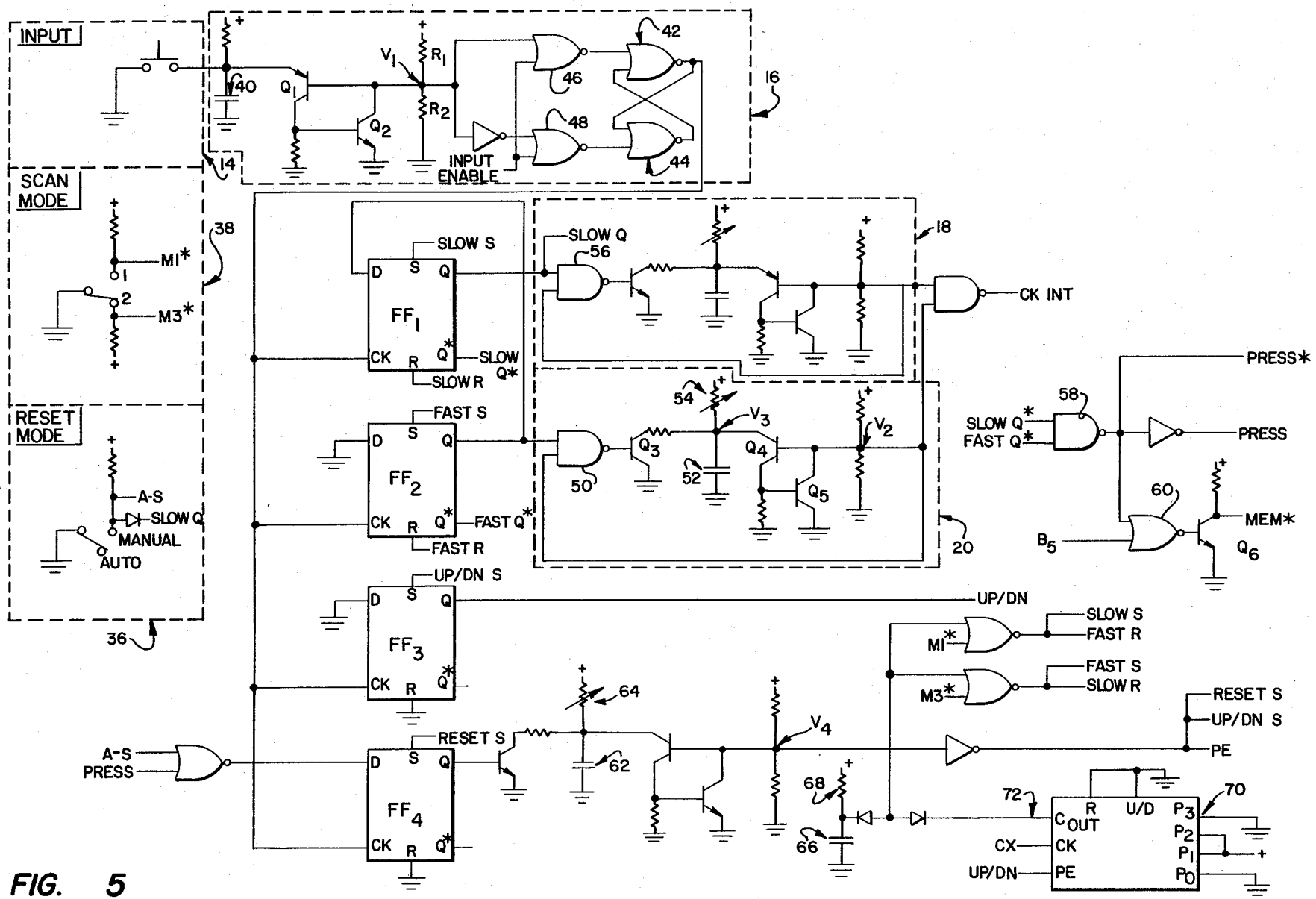
FIG. 5 is a schematic diagram of the input and control logic for a preferred embodiment of the present invention.
Figure 6:
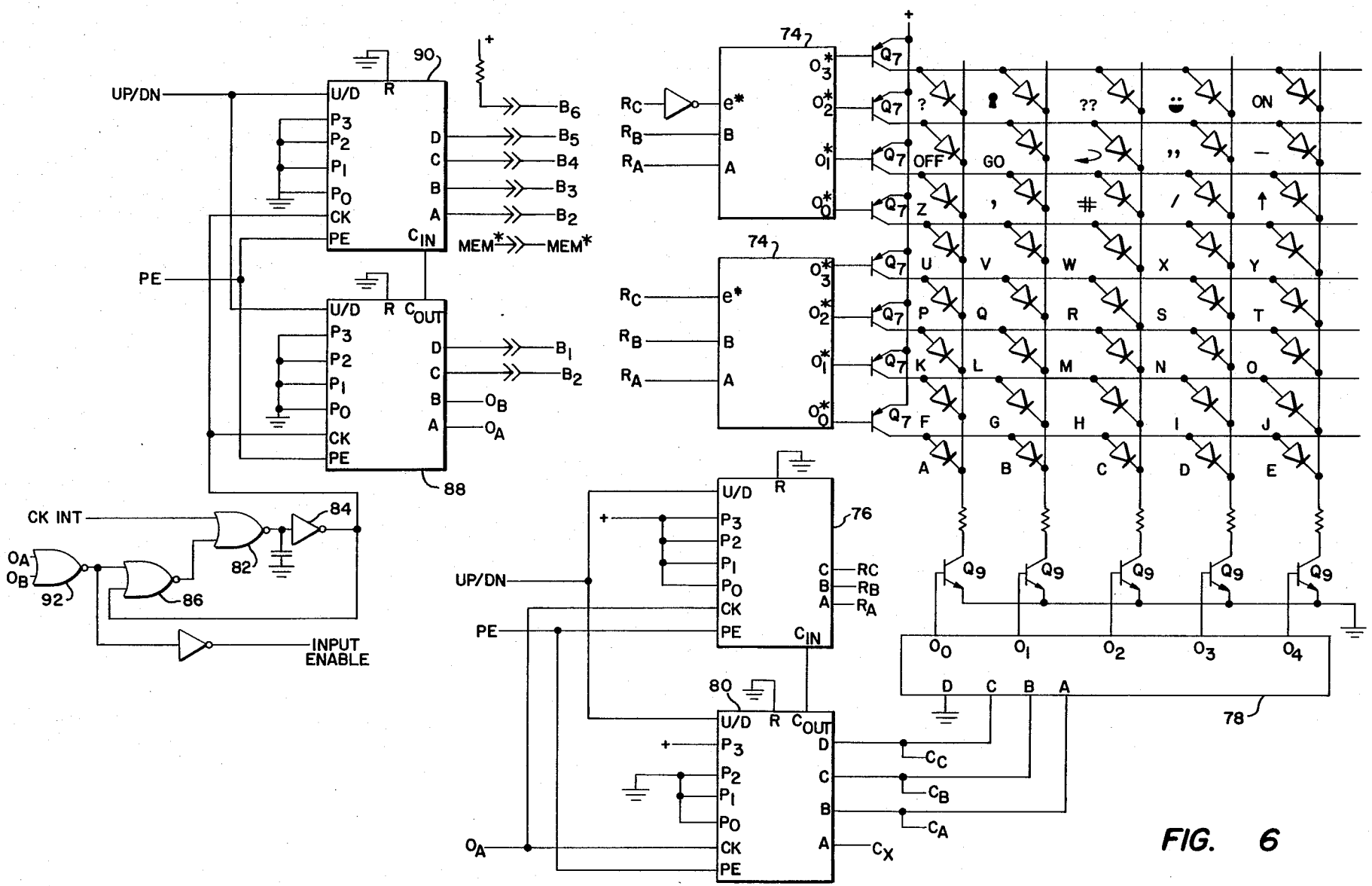
FIG. 6 is a schematic diagram of an LED display and printer driving portions of a preferred embodiment of the present invention.
Figure 7:
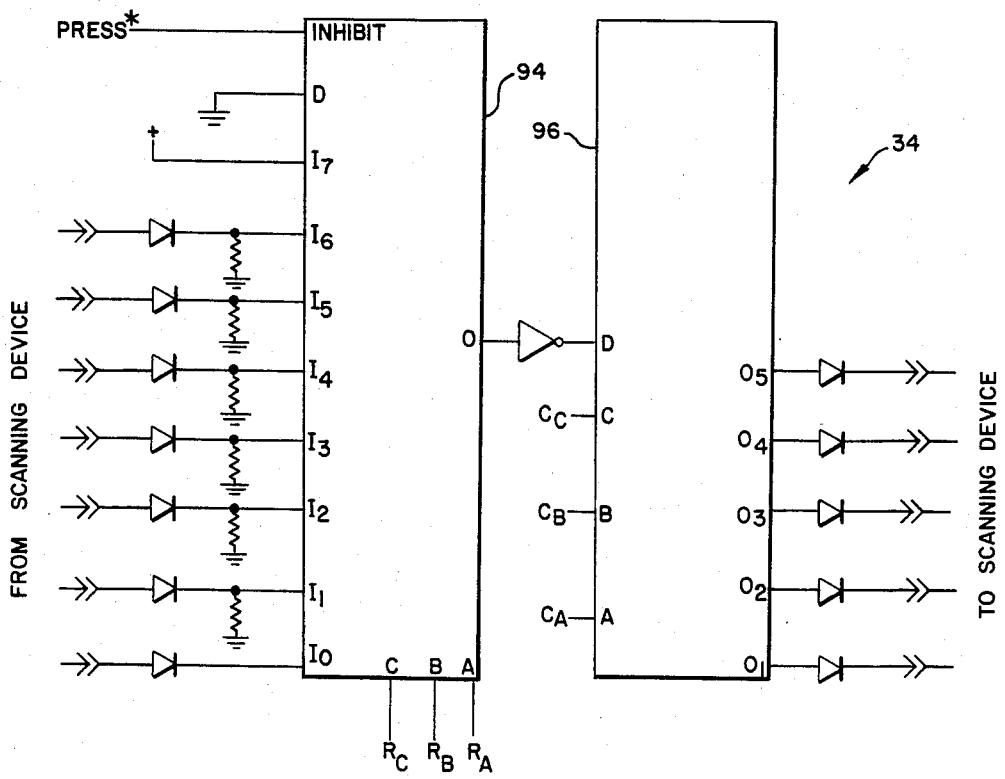
FIG. 7 is a diagram of a circuit for interfacing a keyboard scanner with an electronic switch selection circuit.

A detailed schematic diagram of the simplified diagram of FIG. 3 is shown in FIGS. 5 through 7. The preferred embodiment as shown in these figures includes some additional features not discussed in connection with the basic diagram of FIG. 3. The preferred embodiment includes a mode switch, which allows the device to operate in either the standard linear scanning mode as used by the prior art, or in the improved critically damped scanning mode. Another feature is that the reset mode can be selected to operate as described in FIG. 3, or to reset the device only upon a third switch closure made after the desired element is selected. Preferred operation is for both mode switches to be set so that the device operates as described in connection with FIG. 3.

A portion of the schematic diagram of the preferred embodiment is shown in FIG. 5. A reset mode switch 36 has two positions. An AUTO position which provides for automatic reset after a predetermined delay interval after the element selection is made. The MANUAL position provides that the circuit will not be reset until a third switch closure is made. A scan mode switch 38 has positions 1 and 2, with position 1 connecting logical variable M1* to ground, and position 2 connecting the variable M3* to ground. The variable which is not connected to ground is coupled to the power supply, and is therefore a logical High. When the scan mode switch 38 is set to position 1, the device operates in the linear scanning mode. When the mode switch is in position 2, the device operates in the high speed, bi-directional mode.

The input switch 14 is merely a normally open mechanical switch coupled to a debounce circuit 16. When the switch 14 is open, the capacitor 40 is charged and both transistors $Q_1$, $Q_2$ are on, causing the voltage $V_1$ to be Low (ground). When the input switch 14 is closed, the capacitor 40 is shorted to ground causing the transistors $Q_1$, $Q_2$ to turn off and the junction voltage $V_1$ to become High, the exact voltage being determined by the ratio of the resistors $R_1$, $R_2$. Two cross coupled NOR gates 42,44 to form an SR flipflop, and two additional gates 46, 48 form an input buffer. The state of the flipflop will not change unless the INPUT ENABLE signal is Low. Derivation of the INPUT ENABLE signal is discussed in connection with FIG. 6. When the input switch 14 is depressed and released, the junction voltage $V_1$ goes High, then Low, which causes the NOR gate flipflop, to generate a pulse. This pulse is coupled to the clock (CK) inputs of the control flipflops $FF_1$, $FF_2$, $FF_3$, $FF_4$, and acts as their triggering signal.

When the device 12 is set in the two speed scanning mode, the fast flipflop $FF_2$ is initially set, giving a High output, and the slow flipflop $FF_1$ is initially reset to give a Low output. This causes the fast oscillator 20 to operate while the slow oscillator 18 does not. Both oscillators 18, 20 are astable logical devices having a controllable delay time on one side of the cycle. Referring to the fast oscillator 20, when the fast flipflop $FF_2$ output is High, and coupled to one input of a NAND gate 50, the output of the NAND gate 50 is determined by its other input, coupled to voltage $V_2$. When the NAND gate 50 output is Low, the transistor $Q_3$ is off, causing the capacitor voltage $V_3$ to be High. This causes the next two transistors $Q_4$, $Q_5$ to both be on, so that voltage $V_2$ is Low. When voltage $V_2$ is Low, the NAND gate 50 output is driven High, turing on the transistor $Q_3$ and driving the capacitor voltage $V_3$ near to the ground. This turns off the two transistors $Q_4$ and $Q_5$, causing voltage $V_2$ to go High. When $V_2$ goes High, the NAND gate 50 output again goes Low, turning the transistor $Q_3$ off and allowing the capacitor voltage $V_3$ to go High after a delay determined by the capacitor 52 and variable resistor 54 values. When the voltage $V_3$ becomes somewhat greater than $V_2$, the emitter voltage of the transistor $Q_4$ is higher than the base causing both transistors $Q_4$, $Q_5$ to turn on, driving $V_2$ Low. This cycle repeats as long as the output from the fast flipflop $FF_2$ is High. The oscillator 20 frequency is determined primarily by the recharge rate of the capacitor 52, and only incidentally by the delay times imposed by the various transistors $Q_3$, $Q_4$, $Q_5$ and NAND gate 50. This frequency can be varied by adjusting the variable resistor 54 to meet the constraints imposed by the reaction time of the user.

The slow flipflop $FF_1$ was initially reset, so that its output was Low. This causes the output of the slow oscillator NAND gate 56 to always remain High, whereby the slow oscillator 18 does not operate. The D input of the slow flipflop $FF_1$ is coupled to the output of the fast flipflop $FF_2$, so that the slow flipflop $FF_1$ changes state upon receipt of a clock pulse. This causes the slow oscillator 18 to begin operation.

When the device 12 is in the forward scan mode, a clock pulse is generated by a switch closure as described above. This first clock signal causes the fast oscillator 20 to cease operation and the slow oscillator 18 to begin operation. At the same time, the direction flipflop $FF_3$ switches from an initial High output setting, corresponding to a forward scan, to a Low output. This causes the device 12 to begin scanning in the reverse direction.

The output of the fast flipflop $FF_2$ remains Low after the first clock pulse because its D input is grounded. After the second clock pulse, the output of the slow flipflop $FF_1$ goes Low, so that neither oscillator 18, 20 is operating. When the first flipflop $FF_1$ output goes Low, SLOW Q* and FAST Q* are both High causing the output of a NAND gate 58 to go Low. Thus, the signal PRESS is High, and PRESS* is Low, after the second clock pulse is received by the flipflops $FF_1$, $FF_2$, $FF_3$, $FF_4$. This indicates to the system that the desired element has been selected by the user.

When PRESS* is High, the output of a NOR gate 60 will be Low, causing MEM* to be High. While PRESS* is Low, the output of the NOR gate 60 will depend on the level of Signal $B_5$. When $B_5$ is High, the NOR gate 60 output will be Low, transistor $Q_6$ will be off, and signal MEM* will be High. If $B_5$ is Low, the transistor $Q_6$ will be turned on and the signal MEM* will be Low. MEM* is used in connection with the optional printer interface 28 discussed in connection with FIG. 6.

Prior to the receipt of the first clock pulse, the output of the reset flipflop $FF_4$ is High, which drives $V_4$ High after a predetermined delay in the same manner as described with relation to the astable multivibrators utilized in the fast and slow oscillators 18, 20. Upon receipt of the first clock pulse, the reset flipflop $FF_4$ output is High because the D input, the NOR summation of PRESS(Low) and A.S(Low), is High.

Shortly after the first clock pulse, Slow Q goes High as described above, allowing A.S to go High. This causes the signal at the D input of $FF_4$ to go Low. Upon receipt of the second clock pulse, the output of the reset flipflop $FF_4$ goes Low, because a Low signal is present on the D input. After the predetermined delay period, which is set by the values of the capacitor 62 and variable resistor 64, $V_4$ is driven Low. This causes the circuit to reset by driving FAST S, SLOW R, RESET S, UP/DN S and PE High. When $FF_4$ goes High, as a result of RESET S going High, $V_4$ is driven High after a delay. This causes the various reset signals to go Low, so that the circuit begins operation in its initial state.

When the Reset Mode Switch 36 is set to MANUAL position, A.S remains Low. The D input to $FF_4$ therefore remains High until after the second clock pulse, when PRESS goes High. Therefore, $FF_4$ will not cause the circuit to reset until the receipt of a third clock pulse.

Capacitor 66 and resistor 68 cause the circuit 12 to reset when it is originally powered up. When power is applied, capacitor 66 charges gradually, causing $V_4$ to be drawn Low for a period sufficient for the logic elements to power up. As capacitor 66 charges, $V_4$ can go high, starting proper operation of the device 12.

Counter 70 resets the device 12 when the predetermined number of reverse scan presentations has been made. When the UP/DN signal is High, indicating the device 12 is counting up, the counter 70 is preset to the preselected value upon receipt of each clock signal $C_x$. Derivation of $C_x$ will be described in connection with FIG. 6. When UP/DN goes Low, indicating the device 12 is reverse scanning, each $C_x$ input causes the counter 70 to count down. $C_x$ pulses once for each element presentation made during the reverse scan. The carry output 72 goes Low when the counter 70 counts down to 1. This causes $V_4$ to go Low, and the device to be reset. As shown, the counter 70 is preset to 6, so that a maximum of 5 elements are presented in the reverse scan. By changing the preset inputs ($P_0$, $P_1$, $P_2$, $P_3$), the counter 70 can be set to limit the reverse scan presentations to any desired value.

A decoder/divider for the LED matrix of FIG. 4 is shown in FIG. 6. The diodes are matrixed in an eight row by five column array, with two rows from the matrix corresponding to one row of the display board shown in FIG. 4. The 8 X 5 matrix scans from the lower left corner to the upper right corner on a row by row basis. Each LED is lit by connecting one matrix row to the positive power supply, and one matrix column to ground, thus driving a single LED. The row to power supply connection is made by driving transistors $Q_7$ through two inverting 2 line to 4 line decoders 74 as shown in FIG. 6. It would also be possible to substitute a single 3 to 8 line decoder (not shown) for the two shown in FIG. 6. The decoders 74 are driven by row select signals $R_A$, $R_B$, $R_C$ derived from a binary up/-down counter 76.

The column to be coupled to ground is selected by driving transistors $Q_9$ from the output of a BCD to 10 line decoder 78, of which only the first five outputs are used. The column selected is determined by three column select inputs $C_A$, $C_B$, $C_C$, which are derived from the B, C, and D outputs of a BCD up/down counter 80. Since only the last three outputs of the BCD counter are used, the column select signal $C_A$, $C_B$, $C_C$ will cycle through five places.

Both counters 76, 80 can be preset upon receipt of a signal PE in the preset input, and this signal PE is derived from the reset portion of the control circuitry as described in connection with FIG. 5. The counters 76,80 are preset to begin scanning of the array with the upper right hand element, or the "ON" LED. A $C_{in}$ input inhibits the operation of row counter 76, and enables the counter 76 to operate only upon receipt of a Low signal. The $C_{out}$ output of column counter 80 goes Low only after the last clock pulse of each cycle. Therefore, the output of row counter 76 is incremented once each time the column counter 80 cycles, causing the matrix to be scanned row by row. By changing the preset inputs to the counters 76,80, it is possible to begin scanning after reset at any desired position in the matrix. The clock signal for the counters 76,80 is $O_A$, the derivation of which will be described below. The counters 76, 80 are bidirectional, with the direction controlled by the UP/DN signal derived in FIG. 5. The row select signals $R_A$, $R_B$, $C_C$ and column select signals $C_A$, $C_B$, $C_C$ used to control the LED matrix will also be used to drive the keyboard interface circuit 34, as described in FIG. 7.

The CK INT signal is coupled to one input of a NOR gate 82, the output of which is coupled to an inverter 84. The inverter 84 output is fed back to the NOR gate 82 input indirectly through NOR gate 86. The inverter 84 output is also coupled to the clock inputs of a binary 88 and a BCD 90 counter. The A and B outputs of the binary counter 88 (signals $O_A$ and $O_B$) are NORed together in gate 92 and coupled to the second input of the NOR gate 86. The output NOR gate 92 is inverted and used as the INPUT ENABLE signal for the debounce circuitry 16 of FIG. 5.

The subcircuit comprising NOR gates 82, 86 and 92, and inverter 84, is stable when CK INT is Low, and both $O_A$ and $O_B$ are Low. At that point, the output of inverter 84 is Low, as is the output of NOR gate 92. When CK INT goes High, the output of inverter 84 goes High, and clocks counter 88 once, causing $O_A$ to go High. The output of NOR gate 92 is now Low, and will remain that way until $O_A$ and $O_B$ both again go Low. When CK INT goes Low again, the subcircuit becomes astable, and the output of inverter 84 quickly changes state, triggering the clock inputs to the counters 88, 90. The subcircuit becomes stable, and the inverter 84 output stays low, once $O_A$ and $O_B$ become Low. The subcircuit thus generates 4 very fast clock pulses each time CK INT makes one complete cycle. This causes $O_A$ to clock counters 76 and 80 twice, and $C_X$ to clock counter 70 (FIG. 5) once, for each cycle of the CK INT signal. Thus, when CK INT cycles once, all parts of the circuit interpret that event as a single change in position of the presented element of the LED matrix. The INPUT ENABLE signal prevents the device 12 from reading an input while the various logical devices are in the process of changing state to the corresponding to the next element to be presented.

Both the binary and BCD counters 88, 90 become preset to all zeros upon receipt of the preset signal PE. Outputs $B_0$ through $B_6$ correspond to ASCII characters while the device 12 scans the alphabet. The additional characters in the matrix correspond to non alphabetic ASCII codes. As discussed in connection with FIG. 5, MEM* can only go Low when the desired element has been selected. This signals a printer (which is optional, and not shown) to print the character defined by the outputs $B_0$ through $B_6$. In order to minimize the number of non-standard characters printed, the printer is inhibited after the first 32 matrix elements have been scanned. When $B_5$ goes High, MEM* is forced High, which inhibits the printer.

The keyboard interface circuit 34 is shown in FIG. 7. This circuit uses the row select and column select signals $R_A$, $R_B$, $R_C$ and $C_A$, $C_B$, $C_C$ used to drive the LED matrix. The interface 34 is suitable for use in interfacing the present device 12 with a microprocessor or other device normally used to scan a mechanical switch keyboard. (not shown) The interface 34 as shown is adapted for interfacing with the microprocessor that controls the Texas Instruments Speak & Spell product. The interface circuit 34 utilizes the PRESS* signal derived from FIG. 5, and receives inputs from the microprocessor or other scanning device, and has outputs coupled thereto.

A keyboard scanner will typically continuously pulse each row of the keyboard in sequence, and check all columns in parallel for a corresponding pulse. When a column input to the microprocessor records a pulse, the corresponding activated row enables the microcomputer to determine which switch is closed. The present device 12 utilizes no mechanical switches for the keyboard elements, and must use an interfacing circuit to simulate the mechanical switching connection.

The row scan lines, from which a pulse is output from the microprocesser to each keyboard row sequentially, are coupled to the inputs of an 8-1 data selector 94. The line select inputs A, B, C of the data selector 94 are coupled to the row-select signals $R_A$, $R_B$, $R_C$ which control the LED matrix. The PRESS* signal is coupled to an INHIBIT input of the encoder 94, whereby the encoder 94 output is Low whenever the PRESS* signal is High. PRESS* goes Low when the second switch closure indicates that the desired element has been selected. When PRESS* is Low, the output tracks any; signals present on the input line selected by $R_A$, $R_B$ and $R_C$.

The output from the data selector 94 is inverted and coupled to the D input of an encoder 96. The A, B and C inputs of the encoder 96 are coupled to the column select signals $C_A$, $C_B$ and $C_C$ respectively. A High signal is present on whichever output line is defined by the signals at the A, B, C and D inputs. As shown in FIG. 7, only the first 5 outputs are used, so if the signals at the 4 inputs A, B, C, D, with D being the most significant digit, define any number greater than 5, all outputs will be Low. Thus, whenever the D input is High, all outputs will be Low.

When the selected row is pulsed High by the scanning device, this pulse will be passed to the output of the data selector 94, causing the D input to the decoder 96 to pulse Low. During this pulse, the output line defined by the columnm select signals $C_A$, $C_B$, $C_C$ will go High. At the end of the pulse, the selected column output will again be Low.

PRESS* becomes Low only after the input switch 14 has been depressed twice as discussed in connection with FIG. 5. Therefore, until the switch 14 has been pressed twice, therefore selecting the particular element desired, no pulse signals are input to the microprocessor through the decoder 96 outputs. Once PRESS* goes Low, the row and column of the selected element become fixed as described in connection with FIG. 6, and the keyboard interface 34 operates to indicate the position of the selected item. The inputs to the data selector 94 are pulsed sequentially, but only the pulse corresponding to the selected row is coupled to the output. This pulse is coupled to the column sense input of the microprocessor as determined by the control signals to the decoder 96. Thus, the microprocessor receives a single column sense pulse when the correct row is pulsed by the microprocessor, so that it correctly reads the selected element in a fashion identical to that which would be obtained if mechanical switches on a keyboard were used.

It will become apparent that this keyboard interface 34 can be used to interface an electronic element selection circuit with any keyboard scanning device sensing the closure of a mechanical switch with row scan pulses and column sense inputs. This circuit 34 interfaces a purely electronic selection signal with a keyboard scanner which expects to see an input from a mechanical switch keyboard.

Figure 8:
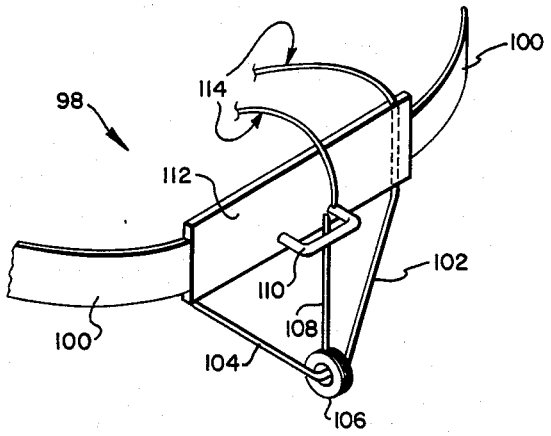
FIG. 8 is a perspective view of a mechanical switch suitable for use by handicapped persons.

According to the present invention, any simple electric switch which is manipulable by the user may be used as an input switch. A preferred switch 98 for use by certain severely disabled individuals is shown in FIG. 8. This device is especially suitable for persons who have been paralyzed from the neck, or lower face, down. It is a switch which is manipulable by movements of one of the user's eyebrows, and requires only that the user be able to control movements of his eyebrow muscles. It will become apparent that, with only slight modifications, the switch 98 may be used with other regions of the body. Any area where the skin wrinkles, or where 2 parts move relative to each other, may be used. Examples of such areas are the fingers, wrist or elbow.

The switch 98 has an elastic band 100 which is attached around the head of the user, and holds the switch 98 firmly in place on the user's forehead. Two wheel supports 102, 104 hold a small pivotable wheel 106 in place, to which is attached a conducting lever arm 108 that protrudes through the pivotal wheel 106 to make electrical contact with wheel support 102. Wheel support 102 is also conducting. A conducting bracket 110 is attached a rigid, non-conducting support 112, which also supports one end of each of the wheel supports 102,104. The lever arm 108 moves into and out of contact with the bracket 110 when the wheel 106 is rotated about its axis. Connecting wires 114 are coupled to the bracket 110 and the conducting wheel support arm 102.

When the switch 98 is placed in position, the wheel 106 makes contact with the eyebrow of the user. The wheel 106 is preferably made from a soft material, such as rubber, which allows firm contact, with minimum slippage, with the user's eyebrow. When the user's eyebrows are in the relaxed position, the lever arm 108 is pressed back against the nonconducting rigid support 112, and the circuit is open. When the user's eyebrows are raised, the wheel rotates 106 in a clockwise direction as shown in FIG. 8, and the lever arm 108 makes contact with the bracket 110, thereby closing the circuit between the connecting wires 114. When the eyebrows are relaxed, the lever arm 108 breaks contact with the bracket 110, thereby opening the circuit.

Figure 9:
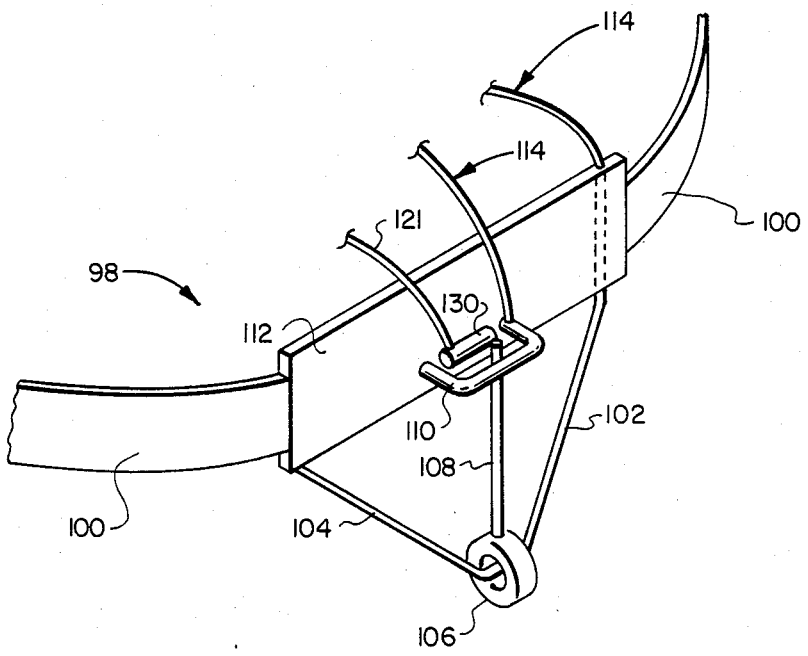
FIG. 9 is a perspective view of an alternative embodiment of the mechanical switch of FIG. 8 suitable for use by handicapped persons.

An alternate embodiment to the switch 98 is shown in FIG. 9 and includes a small conducting piece 120 coupled to the rigid support 112 between the arms of the conducting bracket 110. In this position, the lever arm 108 will make contact when it is moved fully away from the bracket 110. With the addition of a third connecting wire 121 coupled to the small conducting piece, the alternate switch 98 becomes a double throw, single pole (DPST) switch. The DPST switch can be coupled ot debounce or other logical circuitry to ensure accurate detection of an intended switch opening or closure.

It will also be apparent that the elastic band 100 need not be used if the rigid support 112 is adapted to be coupled to another object, such as eyeglass frames. It is apparent only that the switch 98 be held in the desired position, and the means for so doing is less important, as long as patient comfort is provided for.

The switch 98 is suitable for use with the scanning device 12 of the present invention, which requires merely a simple open and close switch. This switch 98 is especially suitable for use with severely disabled persons, as it is easily placed in the operating position and causes no interference with other activities. It will be apprecicated, however, that other suitable switches may be used.

Although a preferred embodiment has been described in detail, it should be understood that various substitutions, alterations, and modifications may become apparent to those skilled in the art. These changes may be made without departing from the spirit and scope of the invention as defined by the appended claims.

What is claimed is:

1. An electrical switch for use by a person and including first and second wires for switchable connection, said switch comprising:

a nonconducting support frame mounted upon the persons body;

a first electrical contact mounted upon and extending from said frame and connected to said first wire; and contacting means for providing contact between said first contact and a electrically conducting leverarm, said contacting means including a friction device positioned against a portion of the person's skin movable by the person in relation to the support frame and supported by a electrically conducting support arm pivotally mounted upon the support frame and connected thereto to said second wire, said leverarm having a first end mounted in said friction device in electrical contact with the support arm and having a second end positioned adjacent to said first contact wherein movement of the portion of the person's skin by the person will cause contact between the first contact and leverarm resulting in an electrical connection between the first and second wires.

2. An electrical switch according to claim 1 wherein said first contact includes a conducting loop extending from said frame and enclosing said leverarm between said frame and said loop.

3. An electrical switch according to claim 2 wherein said friction device is a wheel mounted on said support arm at the wheel axis and having said leverarm mounted on the perimeter of the wheel with the first end extending into said wheel to electrically contact said arm and said second end extending within said first contact loop whereby movement of the persons skin causes an actual rotation of the wheel resulting in movement of said leverarm within said first contact loop.

4. An electrical switch according to claim 3 and further including a third wire connecting to a third contact, said third contact mounted upon the surface of said support frame adjacent and electrically isolated from said first contact whereby said movement of the portion of the persons skin by the person causes the leverarm to contact third contact or said first contact.

5. An electrical switch operable by movement on a first portion of a persons body relative to a second portion, said switch including two wires for switchable connection and comprising:

a band mounted upon said second portion and including a nonconducting frame with a first electrical contact extending from one point on said frame to a second point on said frame forming a loop extending from said frame and having said first wire connected to said first contact; and an electrically conducting support bracket pivotally mounted upon said frame encompassing said first contact, said bracket extending from said frame and including a friction wheel rotationally mounted on the bracket, said wheel including an electrically conductive leverarm located on the perimeter of the wheel and extending through the wheel making electrical contact with said bracket and having an opposite leverarm end extending within said loop formed by said first contact, said wheel located to rest against said first body portion and rotatable upon movement of said first body portion causing said leverarm to make and break contact with said first contact.

6. An electrical switch according to claim 5 further including a third wire connected to an electrically conductive rail mounted upon said frame adjacent to but electrically isolated from said first contact wherein movement of said first body portion causes said leverarm to contact said rail or said first contact.

* * * * *